US007594382B2

(12) United States Patent
Weide et al.

(10) Patent No.: US 7,594,382 B2
(45) Date of Patent: Sep. 29, 2009

(54) JOINING METHOD ON A JET SPINNING MACHINE, SPINNING DEVICE AND JET SPINNING MACHINE

(75) Inventors: Thomas Weide, Mönchengladbach (DE); Helmut Feuerlohn, Mönchengladbach (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 52 days.

(21) Appl. No.: 11/920,337

(22) PCT Filed: Mar. 28, 2006

(86) PCT No.: PCT/EP2006/002795

§ 371 (c)(1), (2), (4) Date: Nov. 13, 2007

(87) PCT Pub. No.: WO2006/122605

PCT Pub. Date: Nov. 23, 2006

(65) Prior Publication Data

US 2009/0094958 A1 Apr. 16, 2009

(30) Foreign Application Priority Data

May 13, 2005 (DE) ..... 10 2005 022 187

(51) Int. Cl.
*B65H 69/06* (2006.01)
*D01H 4/48* (2006.01)

(52) U.S. Cl. ..... 57/263; 57/22

(58) Field of Classification Search ..... 57/22, 57/263, 350
See application file for complete search history.

(56) References Cited

U.S. PATENT DOCUMENTS

| | | | | |
|---|---|---|---|---|
| 5,511,373 | A | 4/1996 | Banba | 57/328 |
| 5,619,848 | A * | 4/1997 | Costales et al. | 57/261 |
| 5,813,209 | A * | 9/1998 | Hirao et al. | 57/261 |
| 7,437,867 | B2 * | 10/2008 | Sawada | 57/3 |

FOREIGN PATENT DOCUMENTS

| | | |
|---|---|---|
| DE | 36 11 050 A1 | 10/1987 |
| DE | 195 01 545 A1 | 7/1995 |
| EP | 1 072 702 A2 | 4/2000 |

* cited by examiner

*Primary Examiner*—Shaun R Hurley
(74) *Attorney, Agent, or Firm*—K&L Gates LLP

(57) ABSTRACT

A joining method wherein fibers of a fiber band are wound around an auxiliary thread threaded into a spinning device and drawn through a spinning cone. The newly spun thread is separated from the auxiliary thread and connected to the end of an upper thread. A spinning device is provided for a jet spinning machine for carrying out such method, comprising a first clamping device for temporary clamping of the upper thread and a second clamping device for temporary clamping of the auxiliary thread. A jet spinning machine for carrying out the method has a mechanism for storing the auxiliary thread and the newly spun thread, a mechanism for separating the auxiliary thread from the newly spun thread, and a splicing mechanism for connecting the newly spun thread to the upper thread, all arranged only on at least one operating carriage displaceable along multiple spinning stations.

14 Claims, 10 Drawing Sheets

JOINING METHOD ON A JET SPINNING MACHINE, SPINNING DEVICE AND JET SPINNING MACHINE

CROSS-REFERENCES TO RELATED APPLICATIONS

This application claims the benefit of German patent application 10 2005 022 187.4, filed May 13, 2005, herein incorporated by reference.

BACKGROUND OF THE INVENTION

The invention relates to a joining method on a jet spinning machine, as well as a spinning device and a jet spinning machine for carrying out the joining method.

Jet spinning machines generally comprise spinning devices, to which a fibre band drawn to a fibre bundle is supplied from a drawing frame. The fibre band runs through a spinning nozzle, in which it is acted upon by swirling air currents and is thereby provided with a true torsion or true twist. Positioned downstream from the spinning nozzle is a hollow spinning cone, through which the fibre band is drawn off as a thread from an outlet opening and then wound onto a take-up bobbin as the upper thread.

German Patent Publication DE 3611050 A1 describes a spinning unit, which is intended to produce bobbins being used a feed bobbins for twisting. Substantially untwisted thread components are wound onto the feed bobbins. For joining, two auxiliary threads are in each case drawn off from an auxiliary bobbin. The ends of the auxiliary threads are transferred with the aid of thread clamps to a suction device and then placed by the thread clamps in a draw-off mechanism configured as a pair of rollers, then into the false twist mechanism and finally, from the side, into the pair of withdrawal rollers of a drawing frame. The activated false twisting mechanism acts upon the auxiliary threads with a false twist. The auxiliary threads transport the false twist counter to the thread running direction to the withdrawal rollers of the drawing frame. For joining, a fibre strand is fed onto the running auxiliary threads, in each case, from the drawing frame. The auxiliary threads and the fibre strand supplied to them in each case are now together provided with a false twist by the false twist mechanism from the withdrawal rollers of the drawing frame to the false twist mechanism. The spinning unit of German Patent Publication DE 3611050 A1 is not suitable for producing a spun thread with a true twist. Inserting the auxiliary threads according to the disclosure of German Patent Publication DE 3611050 A1, from the side, is not possible when using jet spinning devices, which operate with a twist retaining mechanism and a hollow spinning cone.

A jet spinning machine is described in European Patent Publication EP 1 072 702 A2, as prior art, in which during a start or when a thread breaks the end of the upper thread is transported by means of a transfer arm into the vicinity of the outlet opening of the spinning cone designated a spindle. From there, the upper thread runs from the direction opposed to the thread delivery side through the spinning cone and the spinning nozzle and is sucked into a suction element. The fibre bundle on the delivery side, which exits from the drawing frame is also sucked into the suction element and intertwined with the upper thread. The two intertwined threads are then sucked into the spinning nozzle for connection. In this method, the upper thread has to be advanced from the spinning device to the suction element in the direction opposing the spinning operation. During this preparation phase for thread connection, errors frequently occur which disturb the formation of a thread connection or even prevent it. A further disadvantage is that the thread portion, which contains the connection between the upper thread and thread bundle is clearly recognisably thicker than the remaining thread. A thick location of this type has a disruptive effect in the end product, for example a woven fabric and is a quality defect. Apart from the disadvantage that the thread connection process is frequently unsuccessful, the length of the thread portion, which forms the piecer can hardly be controlled. Approximately the same lengths of the piecer are not ensured.

In order to overcome these problems, European Patent Publication EP 1 072 702 A2 proposes a spinning device for an alternative joining method. This spinning device has a spinning cone with joining nozzles close to the tip and an axially extending spinning thread channel, through which the spinning thread is drawn off. The spinning thread channel widens towards its thread outlet side in a stepped manner. These joining nozzles are used to generate swirling air currents in the spinning cone by means of supplied compressed air, by means of which a reduced pressure is generated at the tip of the spinning cone. If compressed air acts on the conventional spinning nozzles and also the joining nozzles arranged downstream from the spinning nozzles in the spinning cone, the fibre bundle supplied by the drawing frame is firstly acted upon by a rotational flow and conveyed to the mouth of the spinning thread channel at the tip of the spinning cone. Owing to the reduced pressure produced there by the activated joining nozzles, the fibre bundle is sucked into the spinning thread channel, acted upon by a rotational flow revolving counter to the spinning nozzles when passing through the joining nozzles and transported by the outflowing compressed air to the thread outlet end. The joining nozzles provide the fibre bundle with a false twist briefly during joining. Once the thread has reached the take-off rollers arranged downstream from the spinning cone and is clamped there, the joining nozzles are deactivated, and a normal thread with a true twist is then spun. The thread portion which has been spun with a false twist, is cut off and the end of the newly spun yarn is connected to the end of the upper thread drawn off from the take-up bobbin by a splicing device.

So the tip of the fibre bundle can be sucked into the spinning cone during the joining process, the bore diameter of the mouth of the spinning thread channel has to have a minimum size, which is, for example, a diameter of 1 mm. The limitation of the bore diameter leads decisively to limitations in the influencing of the yarn character.

SUMMARY OF THE INVENTION

The object of the invention is to eliminate the aforementioned disadvantages.

This object is achieved by a method of joining executed on a spinning device of a jet spinning machine, and by a spinning device for a jet spinning machine and an improved jet spinning machine.

According to the joining method of the present invention, a fibre band drawn to yarn thickness is supplied by a drawing frame to the spinning device, between an input-side mechanical twist retaining mechanism and a spinning cone, a rotational flow is produced by a spinning nozzle mechanism, which collects fibres forming free fibre ends and winds them producing a true twist around fibres which do not take part in the rotation and are already incorporated, and the thread thus formed from the fibre band is drawn through the hollow spinning cone. For joining, an auxiliary thread is used, which is firstly threaded by its free end into the spinning device and drawn through the spinning cone. Joining then takes place on the continuous auxiliary thread not taking part in the torsion, in that the fibres of the fibre band are fed onto the auxiliary thread and wound around it. The auxiliary thread being subjected to the withdrawal is guided off and after passing the auxiliary thread end, the newly spun thread, which is free of auxiliary thread, is separated and connected to the end of the upper thread by a knot or a splice.

The invention also provides a spinning device for a jet spinning machine for carrying out the joining method above, which comprises a spinning nozzle mechanism for producing an injector flow and a spinning cone for thread formation. According to the invention, a first clamping device for temporary clamping of the upper thread and a second clamping device for temporary clamping of the auxiliary thread are associated with the spinning device.

The jet spinning machine of the invention has spinning stations arranged next to one another in a row for carrying out the joining method above. According to the invention, a storage mechanism for storing the auxiliary thread and the newly spun thread, a separating mechanism for separating the auxiliary thread from the thread and a splicing mechanism for connecting the newly spun thread to the upper thread are arranged only on at least one operating carriage which can be displaced along the spinning station.

The invention allows a simple threading in of a joining thread and reduces the number of unsuccessful joining attempts. The yarn character can be better influenced. If a splicing connection is selected, only a splice connection which is practically identical to the yarn remains in the finished yarn which leads to no reduction in quality of the finished product.

If the auxiliary thread differs with respect to its properties from the remaining thread, the auxiliary thread can be selected such that a better threading in is achieved with it. Particularly suitable is an auxiliary thread, which is stiffer and/or smoother than the remaining thread. It may also be advantageous if the auxiliary thread is stronger or finer than the remaining thread.

Compared with the method of introducing the end of an upper thread counter to the normal thread running direction during spinning operation, into the spinning device, before joining takes place, the use of an auxiliary thread allows a significant improvement in insertion. In particular, an improvement is to be noted, if instead of introducing only a fibre bundle in the normal thread running direction during spinning operation into the spinning device, an auxiliary thread is used before joining takes place.

In order to reduce the occurrence of errors in joining, the auxiliary thread is introduced into the spinning device in two stages. In this case, in a first stage, the auxiliary thread is introduced into the fibre band channel prior to the spinning nozzle mechanism by means of the injector flow and, in a second stage, the auxiliary thread is introduced into the spinning cone by acting upon the spinning cone by means of reduced pressure. For the introduction of the auxiliary thread, the spinning nozzle mechanism and the spinning cone are temporarily placed so far apart from one another that the auxiliary thread can be manually grasped between the spinning nozzle mechanism and the spinning cone. This allows threading to be carried out in a simple manner, substantially manually. However, it is also possible to automate the handling, at least partially.

If, during joining, a joining speed is adjusted, which is lower than the speed during normal spinning operation, the risk of disruptions of the joining process occurring can be reduced.

A splicing of the thread ends can be expediently prepared if the spinning device has a first clamping mechanism for temporary clamping of the upper thread and a second clamping mechanism for temporary clamping of the auxiliary thread.

The second clamping device is preferably a transporting means for conveying the auxiliary thread and the newly spun thread which then follows. The spinning device preferably has the following components:

A storage mechanism for storing the auxiliary thread and the newly spun thread, a separating device for separating the auxiliary thread from the thread and a splicing mechanism for connecting the newly spun thread to the upper thread.

These components may be stationarily arranged at the spinning station of the jet spinning machine. Alternatively, with a large number of spinning stations at the jet spinning machine, these components may be exclusively arranged at least one operating carriage which can be displaced along the spinning devices of the jet spinning machine. The outlay for construction at the jet spinning machine can thus be reduced.

At least one clamping mechanism for temporary clamping of the auxiliary thread is advantageously arranged at the operating carriage.

BRIEF DESCRIPTION OF THE DRAWINGS

The invention will be described in more detail with the aid of the figures, in which.

DETAILED DESCRIPTION OF THE PREFERRED EMBODIMENTS

Figure 1:
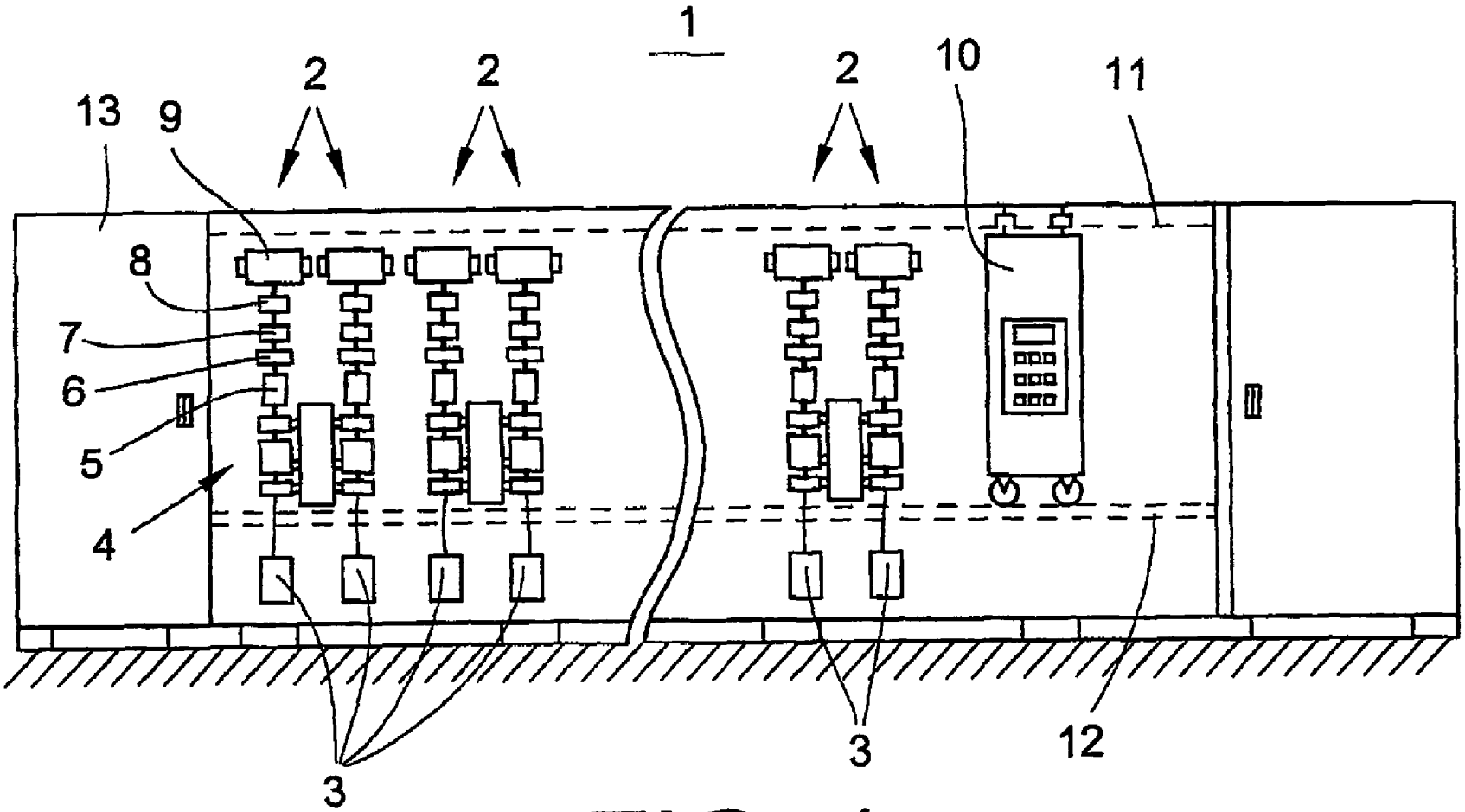
FIG. 1 shows a simplified view of a jet spinning machine.

The jet spinning machine 1 shown in FIG. 1 has a plurality of spinning stations 2 arranged next to one another in a row. Each spinning station 2 comprises a fibre band source 3, which may be configured, for example, as a spinning can, a drawing frame 4, a spinning device 5, a pair of take-off rollers 6, a yarn clearer 7, a thread transfer mechanism 8 and a take-up bobbin configured as a cross-wound bobbin 9. An operating carriage 10 is guided along the spinning stations 2, on bars 11, 12. A drive unit 13 is arranged at one end of the jet spinning machine.

Figure 2:
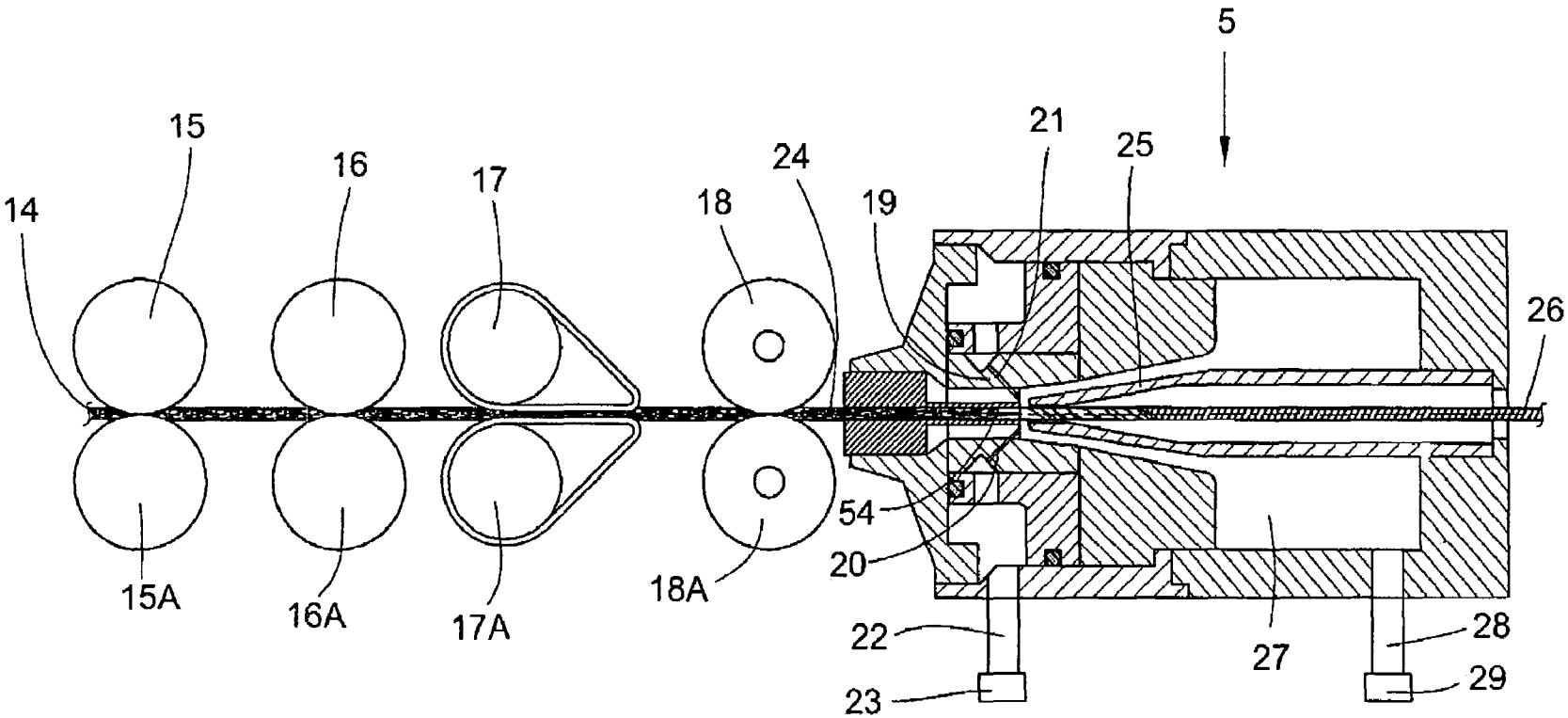
FIG. 2 shows a spinning device of a jet spinning machine with an upstream drawing frame, partially in section and simplified, in an enlarged view compared to FIG. 1.

FIG. 2 shows a drawing frame with a subsequent spinning device 5 and the passage of fibres. The fibre band 14 drawn off from the fibre band source 3 is drawn in by the pair of upper and lower rollers 15, 15A arranged as feed rollers and drawn with the pairs of upper and lower rollers 16, 16A; 17, 17A; 18, 18A. A tweezer-like twist retaining mechanism 54 and a spinning nozzle mechanism 19 are arranged in a first component of the spinning device 5. The nozzles 20, 21 are connected to a compressed air source 23 by means of the line 22. The air flowing out of the nozzles 20, 21 produces a rotational flow, which acts upon the drawn fibre band 24. The second component of the spinning device 5 carries a hollow spinning cone 25. The thread 26 formed in the interaction of the spinning nozzle mechanism 19 and spinning cone 25 is drawn off from the spinning device 5 through the hollow spinning cone 25. The air chamber 27 surrounding the spinning cone 25 is connected to a reduced pressure source 29 by means of the line 28.

Further details with respect to the spinning process by means of spinning devices of this type can be inferred from German Patent Publication DE 199 26 492 A1, for example.

Figure 3:
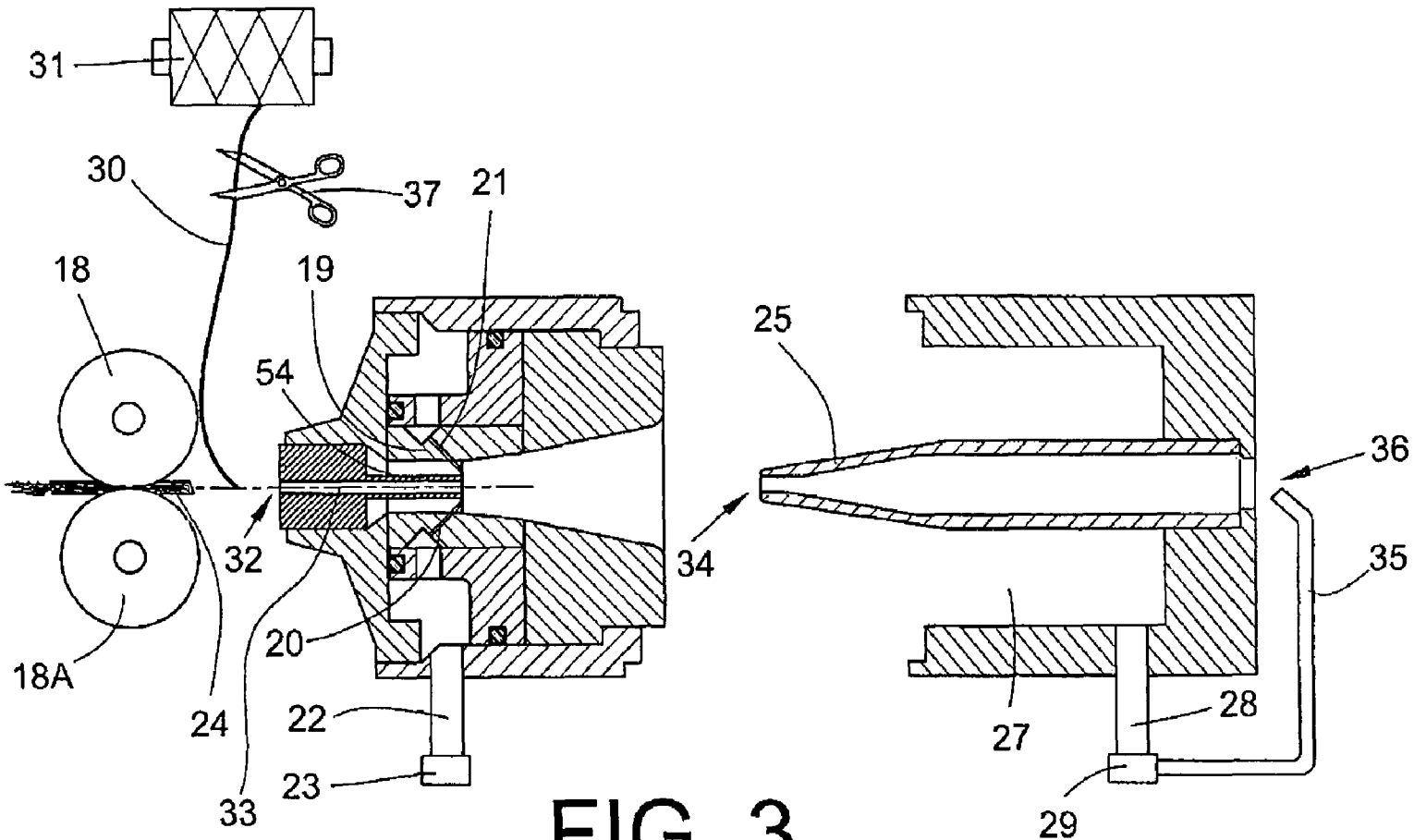
FIG. 3 shows a divided spinning device in the threading position.
Figure 4:
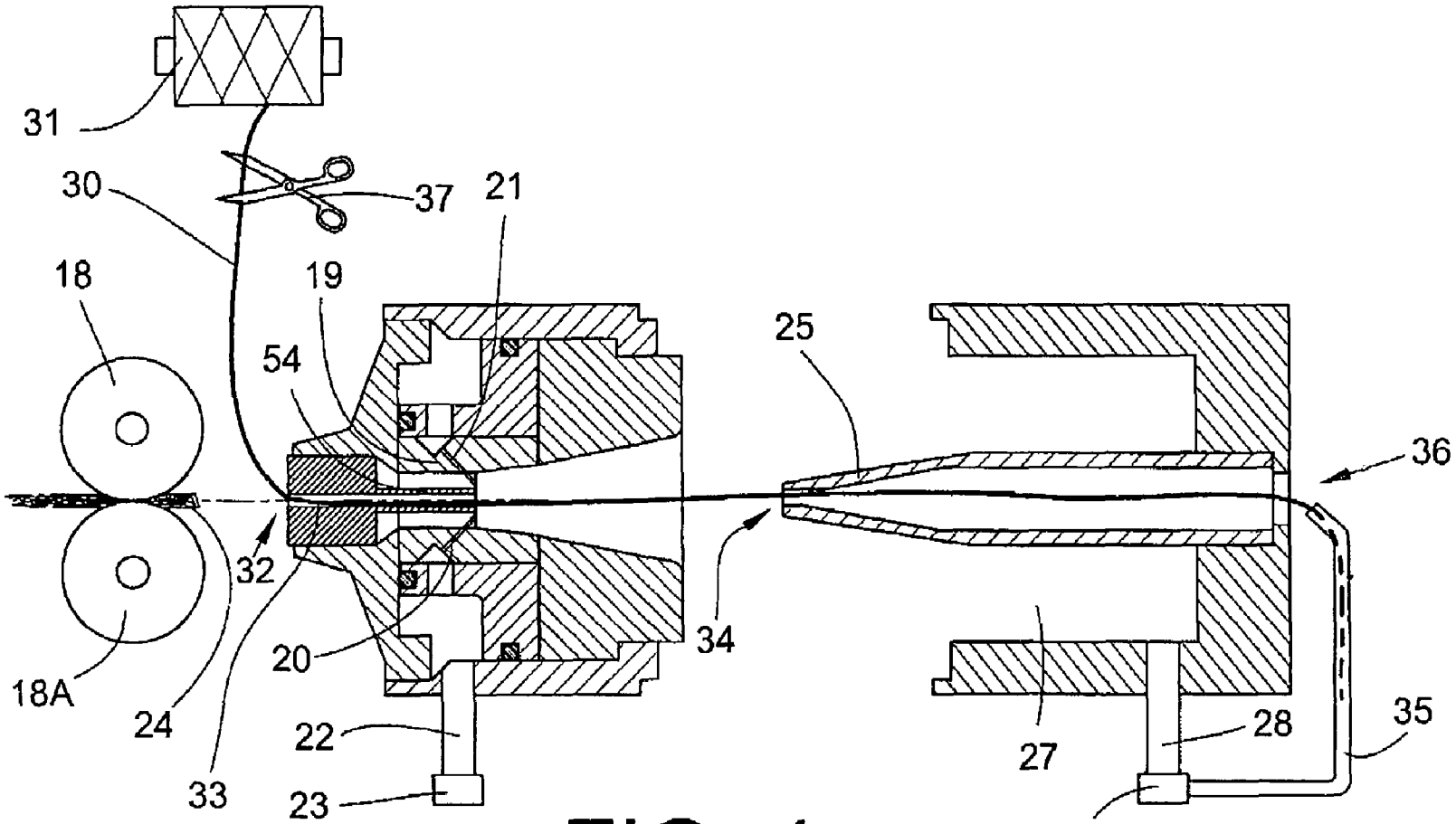
FIG. 4 shows the spinning device of FIG. 3 with a threaded auxiliary thread.

An auxiliary thread 30 is used for joining. For this purpose, the first and second component of the spinning device 5, which are displaceably fastened to a guide, not shown, are displaced so far that a manually assisted threading of the auxiliary thread 30 is possible. As shown in FIG. 3, the free end of the auxiliary thread 30 is drawn off from the auxiliary thread bobbin 31, guided through a cutting mechanism 37 and positioned close to the mouth 32 of the fibre band channel 33. The spinning nozzle mechanism 19 is then briefly acted upon via the line 22 with compressed air from the compressed air source 23. The air flowing from the nozzles 20, 21 produces, in the fibre band channel 33, a reduced pressure by means of which the free end of the auxiliary thread 30 is threaded into the fibre band channel 33 and is transported onward into the vicinity of the mouth 34 of the spinning cone 25. Reduced pressure is now applied to the outlet 36 of the spinning cone 25 by means of a flexible line 35 connected to the reduced pressure source 29 and the auxiliary thread 30 is sucked through the spinning cone 25 into the line 35. This state is shown in FIG. 4. The first and second components are then again displaced into their starting position shown in FIG. 2.

The positioning of the first and the second component and of the auxiliary thread 30 takes place manually in the embodiment. Automatic or partially automatic positioning is possible using corresponding components.

Figure 5:
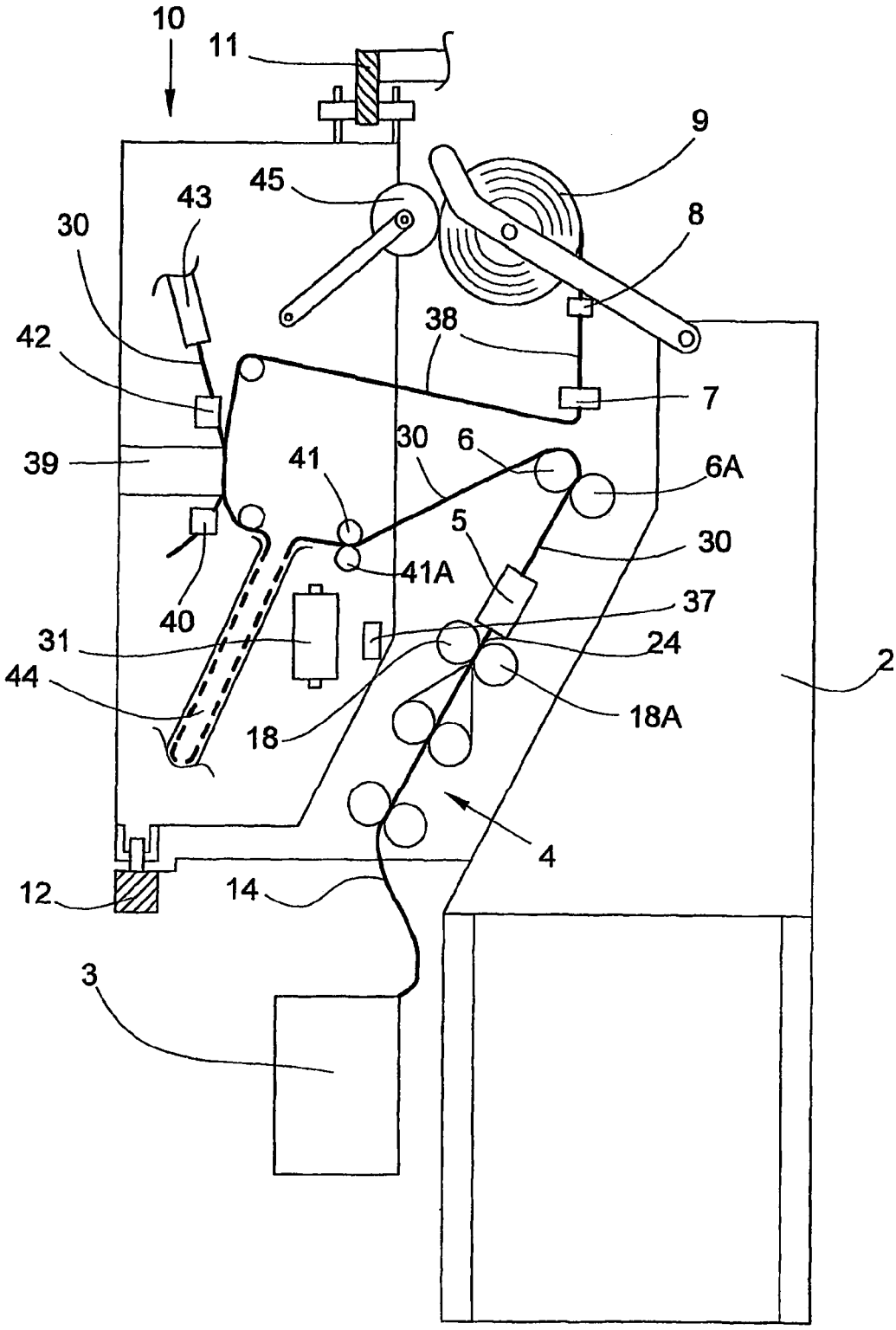
FIG. 5 shows a schematic view of a spinning station with an operating carriage in a side view, prior to the splicing process.

FIG. 5 shows a first phase of a joining process at a spinning station 2 using an operating carriage 10. The operating carriage 10 is positioned at the spinning station 2, at which joining is to take place. The upper thread 38 is drawn off from the cross-wound bobbin 9, the upper thread 38 running through the thread transfer mechanism 8 and the yarn clearer 7 and being placed in the splicing mechanism 39. The free end of the upper thread 38 is clamped in a first clamping mechanism 40. The auxiliary thread 30 is guided by the pair of take-off rollers 6, 6A and further manually by the pair of conveying rollers 41, 41A and placed in the splicing mechanism 39. The end of the auxiliary thread 30 is clamped in a second clamping mechanism 42.

The second clamping mechanism 42 is now released, the suction device 43 is acted upon by reduced pressure and the conveying rollers 41, 41A are made to rotate. The fibre band 24 is conveyed to the mouth 32 of the fibre band channel 33 from the pair of rollers of the drawing frame 4 formed from the upper roller 18 and lower roller 18A and the spinning device 5 is activated. The sucked in fibres of the fibre band 24 are connected onto the running auxiliary thread 30 in the spinning device 5. After a short time, the auxiliary thread 30 is severed by means of the cutting mechanism 37 and the thread is now only formed from the fibre band 24 supplied. When the auxiliary thread 30 including the portion, on which the fibres of the fibre band 24 are joined, has been taken up by the suction device 43, the thread 26 is clamped in the clamping mechanism 42. The thread portion containing the auxiliary thread 30 is separated at the clamping mechanism 42 and sucked up by means of the suction device 43. The splicing mechanism 39 is then actuated. During the splicing process, the thread 26 being continuously spun by the spinning device 5 is taken up by the thread store 44 and stored. Further explanations regarding spinning mechanisms on jet spinning machines are contained, for example, in DE 38 24 850 A1.

Figure 6:
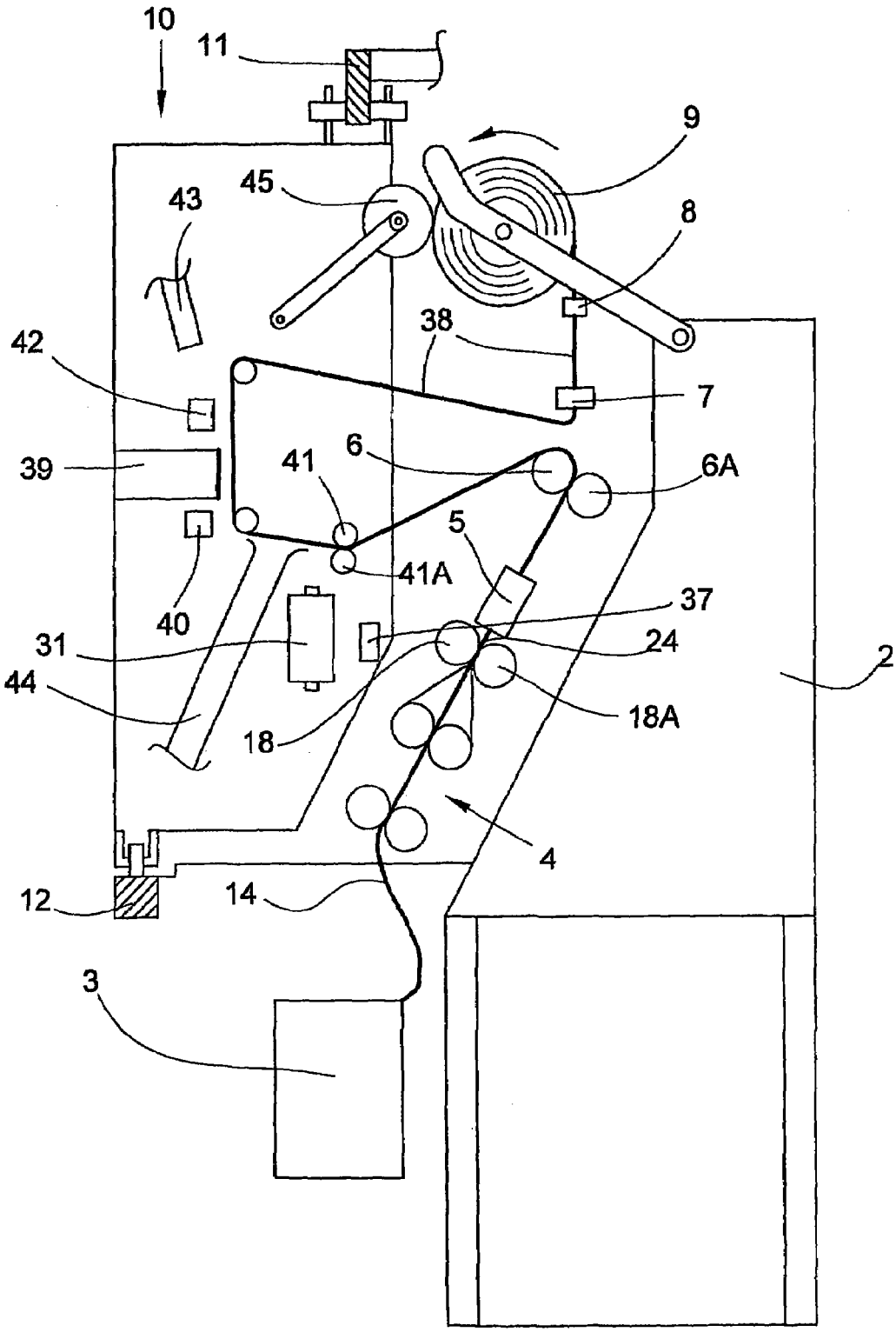
FIG. 6 shows the spinning station of FIG. 5 after the splicing process.

Once the splicing process has ended, the friction roller 45 is placed on the cross-wound bobbin 9 as shown in FIG. 6. The cross-wound bobbin 9 is made to rotate by means of the driven friction roller 45 and winds the upper thread 38. The upper thread 38 is wound on slightly faster than it is delivered from the spinning device 5 until the thread store 44 is emptied again.

Figure 7:
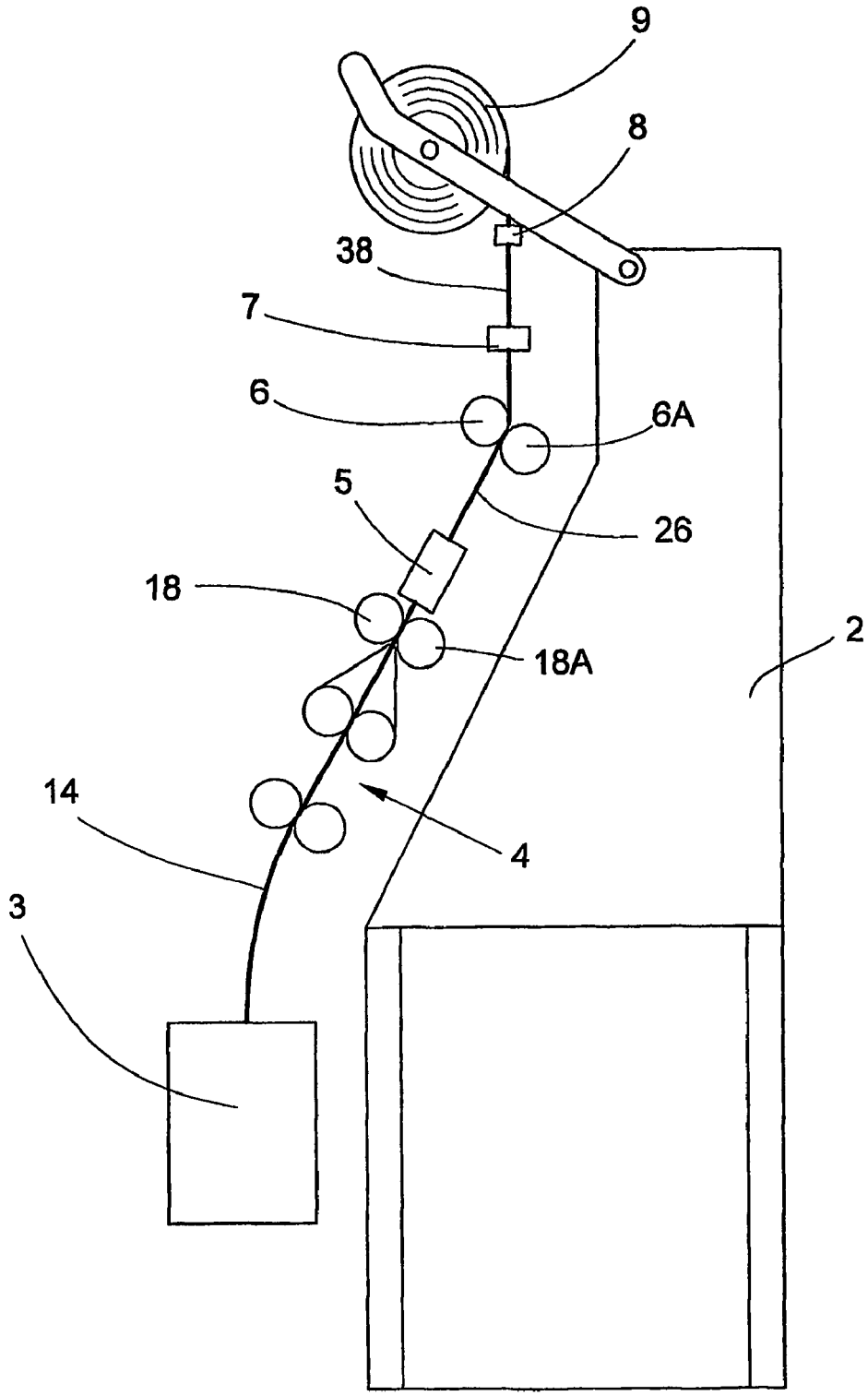
FIG. 7 shows the spinning station of FIG. 5 during normal spinning operation.

The thread 26 is now released by the operating carriage 10, the friction roller 45 pivoted away from the cross-wound bobbin 9 and the normal spinning operation resumed, as shown in FIG. 7. The operating carriage 10 travels to the next spinning station 2, by which it is required for a joining process.

Figure 8:
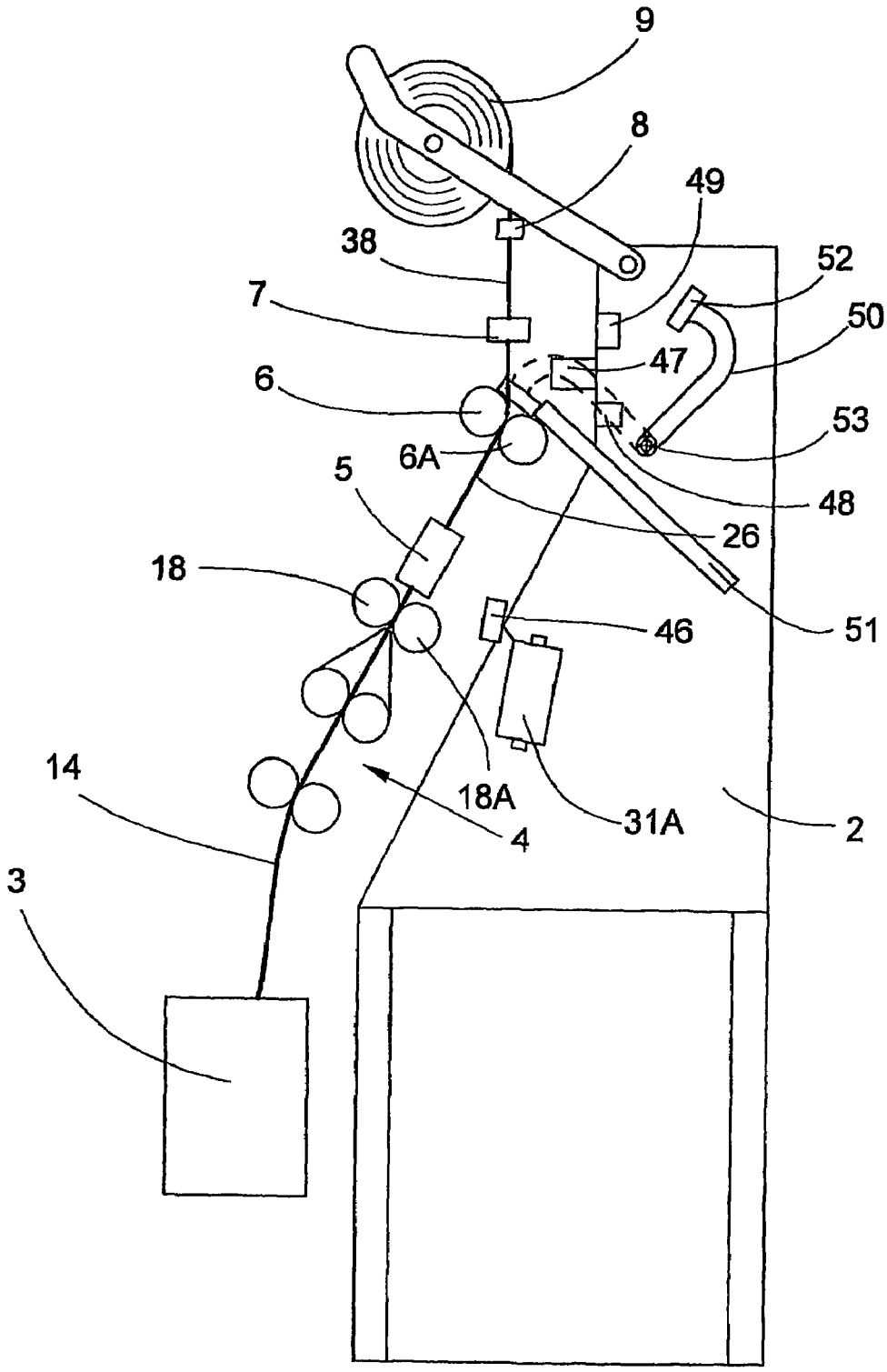
FIG. 8 shows a schematic view of a spinning station in a side view with a splicing mechanism and thread store in normal spinning operation.

FIG. 8 shows an alternative configuration of the spinning station 2 during spinning operation. The spinning station 2 shown comprises a fibre band source, a drawing frame 4, a spinning device 5, a pair of take-off rollers 6, 6A, a yarn clearer 7, a thread transfer mechanism 8 and a cross-wound bobbin 9 as a take-up bobbin, here. The spinning station 2 shown in FIG. 8 also comprises an auxiliary thread bobbin 31A, a cutting mechanism 46, a splicing mechanism 47, a first clamping mechanism 48 for the upper thread 38, a cutting mechanism 49 associated with the splicing mechanism 47, a pivotably mounted suction tube 50, and a thread store 51. For joining after a bobbin change or a thread break, the auxiliary thread 30 is drawn off from the auxiliary thread bobbin 31A, guided through the cutting mechanism 46 and threaded into the spinning device 5 by the method already described above with the aid of FIGS. 2 to 4 and then guided manually through the pair of take-off rollers 6, 6A.

Figure 9:
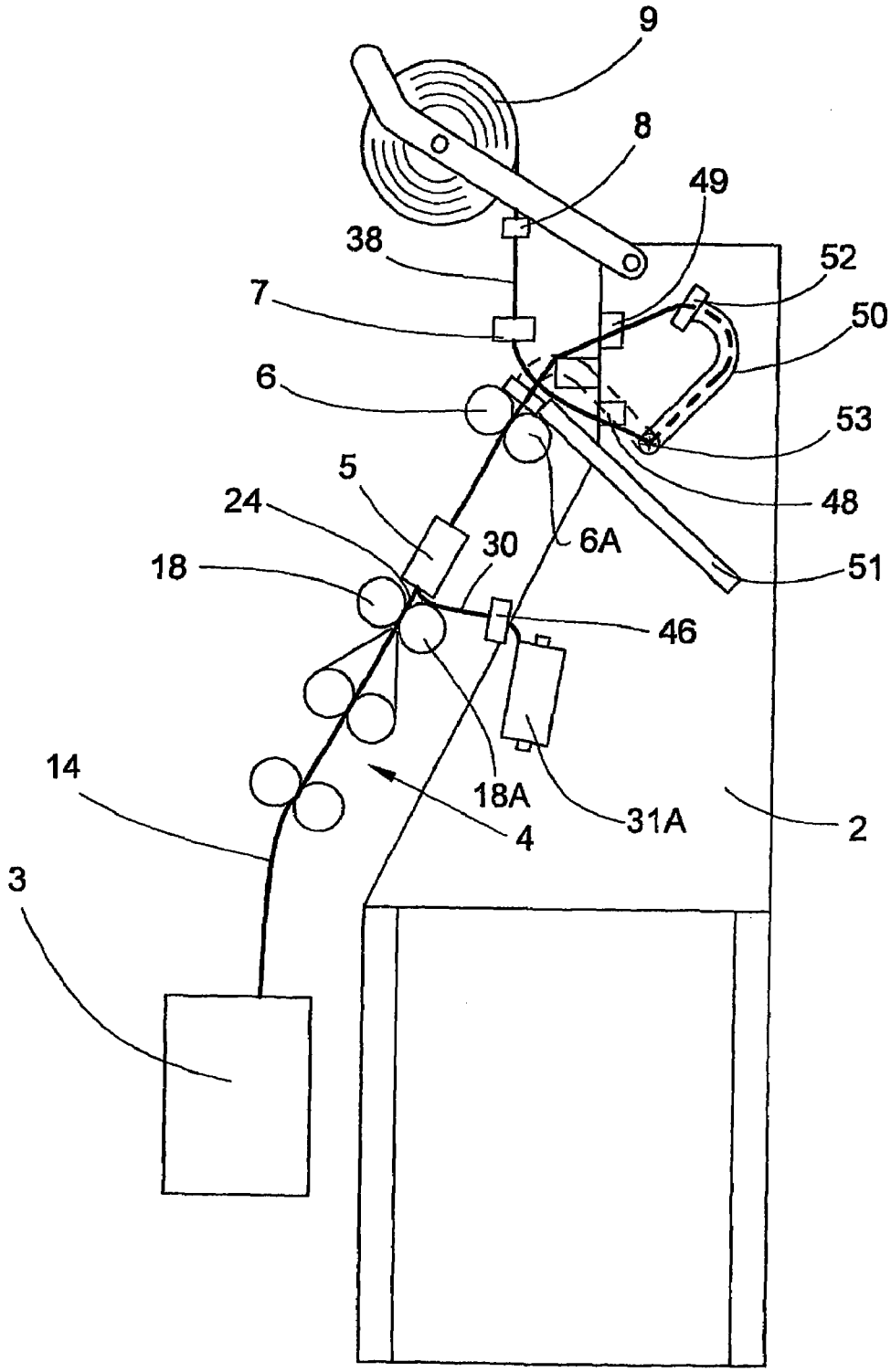
FIG. 9 shows the spinning station of FIG. 8 prior to the splicing process during the joining process.
Figure 10:
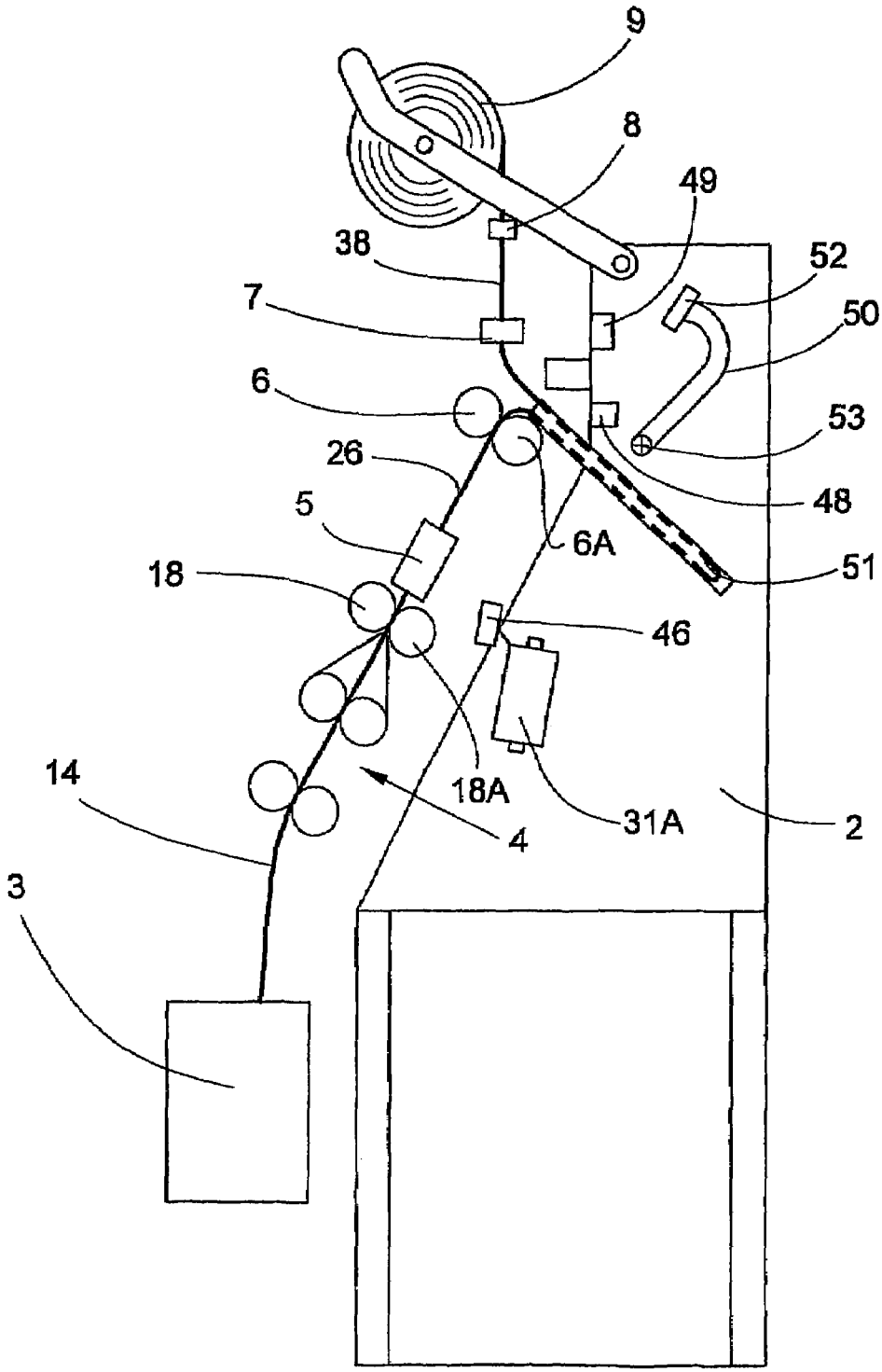
FIG. 10 shows the spinning station of FIG. 8 during the splicing process.

The upper thread 38 is drawn off from the cross-wound bobbin 9, inserted in the clamping mechanism 48 and clamped there. The suction tube 50 is pivoted from its starting position into the position shown by dashed lines. At its free end, the suction tube 50 carries a clamping mechanism 52. A line, not shown, with which the suction tube 50 can be temporarily connected to the reduced pressure source 29, opens at the pivot pin 53 of the suction tube 50. The free end of the auxiliary thread 30 is sucked in, by applying reduced pressure, into the suction tube 50 and clamped by the clamping mechanism 52. The suction tube 50 pivots back into the starting position. The auxiliary thread 30 is placed in the process in the splicing mechanism 47 and in the cutting mechanism 49. The clamping mechanism 52 is opened, the joining process is started and the fibres of the fibre band 24 fed by the drawing frame 4 are connected onto the auxiliary thread 30. This phase is shown in FIG. 9. After a short time, the auxiliary thread 30 is severed by the cutting mechanism 46. When the separated end of the auxiliary thread 30 has passed the clamping mechanism 52, the clamping mechanism 52 is activated. For this purpose, a time span may be predetermined between severing the auxiliary thread 30 and activation of the clamping mechanism 52, which is sufficiently great to completely suck the thread portion with the auxiliary thread 30 reliably into the suction tube 50. The thread portion containing the auxiliary thread 30 is severed by means of the cutting mechanism 49 and sucked up by means of the suction tube 50. The splicing mechanism 47 carries out a splicing process to connect the upper thread 38 and the thread 26. The thread 26 no longer contains an auxiliary thread 30. The thread 26 which was spun during the splicing process is sucked into the thread store 51, as shown in FIG. 10.

After the splicing process has ended, the upper thread 38 is released by the splicing mechanism 47 and the cross-wound bobbin 9 is made to rotate in the arrow direction by a drive, not shown, to wind the upper thread 38. The upper thread 38 is firstly wound at a slightly higher thread speed than the thread 26 is delivered from the spinning device 5, until the thread store 51 is emptied again. The normal spinning operation is now resumed, as shown in FIG. 8.

What is claimed is:

1. Joining method on a spinning device of a jet spinning machine (1), wherein a fibre band (14) drawn to yarn thickness is supplied by a drawing frame (4) to the spinning device (5), between an input-side mechanical twist retaining mechanism (54) and a spinning cone (25), a rotational flow is produced by a spinning nozzle mechanism, which collects fibres forming free fibre ends and winds them producing a true twist around fibres which do not take part in the rotation and are already incorporated, and the thread (26) thus formed from the fibre band (14) is drawn through the hollow spinning cone (25), wherein, for joining, an auxiliary thread (30) is used, which is firstly threaded by its free end into the spinning device (5) and drawn through the spinning cone (25), wherein joining then takes place on the continuous auxiliary thread (30) not taking part in the torsion, in that the fibres of the fibre band (14) are fed onto the auxiliary thread (30) and wound around it, and wherein the auxiliary thread (30) being subjected to the withdrawal is guided off and after passing the auxiliary thread end, the newly spun thread (26), which is free of auxiliary thread, is separated and connected to the end of the upper thread (38) by a knot or a splice.

2. Joining method according to claim 1, characterised in that the auxiliary thread (30) differs from the thread (26) with regard to its properties.

3. Joining method according to claim 2, characterised in that the auxiliary thread (30) is stiffer than the thread (26).

4. Joining method according to claim 2 or 3, characterised in that the auxiliary thread (30) is smoother than the thread (26).

5. Joining method according to claim 1, characterised in that auxiliary thread (30) is introduced into the spinning device (5) counter to the normal thread running direction during the spinning operation, before joining takes place.

6. Joining method according to claim 1, characterised in that the auxiliary thread (30) is introduced into the spinning device (5) in the normal thread running direction during spinning operation, before joining takes place.

7. Joining method according to claim 6, characterised in that the auxiliary thread (30) is introduced into the spinning device (5) in two stages.

8. Joining method according to claim 7, characterised in that, in a first stage, the auxiliary thread (30) is introduced into the fibre band channel (33) prior to the spinning nozzle mechanism (19) by means of the injector flow, and in a second stage, the auxiliary thread (30) is introduced into the spinning cone (25) by means of acting on the spinning cone (25) by means of reduced pressure and in that the spinning nozzle mechanism (19) and the spinning cone (25) are temporarily positioned for the introduction of the auxiliary thread (30) so far apart from one another that the auxiliary thread (30) can be manually grasped between the spinning nozzle mechanism (19) and the spinning cone (25).

9. Joining method according to claim 1, characterised in that during joining, a joining speed is adjusted, which is less than the speed during normal spinning operation.

10. Spinning device on a jet spinning machine for carrying out a joining method, comprising a spinning nozzle mechanism (19) for producing an injector flow and a spinning cone (25) for thread formation, characterised in that a first clamping device (40, 48) for temporary clamping of an upper thread and a second clamping device (42, 52) for temporary clamping of an auxiliary thread (30) are associated with the spinning device (5).

11. Spinning device according to claim 10, characterised in that the second clamping device (52) is configured as a transporting means for conveying the auxiliary thread (30) and the newly spun thread (26) which then follows.

12. Spinning device according to claim 10 or 11, characterised in that at least one storage mechanism for storing the auxiliary thread (30) and the newly spun thread (26), a separating device for separating the auxiliary thread (30) from the thread (26) and a splicing mechanism (47) for connecting the newly spun thread (26) to the upper thread (38) are associated with the spinning device (5).

13. Jet spinning machine with spinning stations arranged next to one another in a row for carrying out a joining method, characterised in that a storage mechanism for storing an auxiliary thread (30) and a newly spun thread (26), a separating mechanism for separating the auxiliary thread (30) from the newly spun thread (26) and a splicing mechanism (39) for connecting the newly spun thread (26) to an upper thread (38) are arranged only on at least one operating carriage (10) which can be displaced along the spinning stations (2).

14. Jet spinning machine according to claim 13, characterised in that at least one clamping mechanism (42) for temporary clamping of the auxiliary thread (30) is arranged on the operating carriage (10).

* * * * *